United States Patent [19]

Dudek et al.

[11] Patent Number: 4,979,450

[45] Date of Patent: Dec. 25, 1990

[54] METHOD AND APPARATUS FOR SEWING FLY PIECES TO A SLIDE FASTENER CHAIN

[75] Inventors: Chet Dudek, Marietta; James Hutcherson, Kennesaw; Kiichirou Ishikawa, Marietta; Yasuhiro Fukumoto, Marietta, all of Ga.; Toshiaki Sawada, Toyama, Japan

[73] Assignee: Yoshida Kogyo K.K., Tokyo, Japan

[21] Appl. No.: 374,743

[22] Filed: Jul. 3, 1989

[51] Int. Cl.[5] ..... D05B 3/12

[52] U.S. Cl. ..... 112/265.2; 112/113

[58] Field of Search ..... 112/104, 113, 121.27, 112/136, 147, 152, 265.2, 304

[56] References Cited

U.S. PATENT DOCUMENTS

| | | | |
|---|---|---|---|
| 3,204,591 | 9/1965 | Pickett | 112/136 |
| 3,570,104 | 3/1971 | Jenson . | |
| 4,152,996 | 5/1979 | Van Amburg | 112/262.3 |
| 4,236,292 | 12/1980 | Orr et al. | 29/408 |
| 4,333,232 | 6/1982 | Orr et al. | 29/767 |
| 4,362,116 | 12/1982 | Sen Gupta et al. | 112/265.2 |
| 4,541,352 | 9/1985 | Boser et al. | 112/265.2 |
| 4,576,104 | 3/1986 | Miyakawa | 112/265.2 |
| 4,594,925 | 6/1986 | Ishikawa | 83/209 |
| 4,608,745 | 9/1986 | Miyakawa et al. | 112/265.2 X |
| 4,611,546 | 9/1986 | Miyakawa | 112/121.27 |
| 4,638,557 | 1/1987 | Sen Gupta | 29/766 |
| 4,644,886 | 2/1987 | Miyakawa | 112/265.2 |
| 4,660,821 | 4/1987 | Boser et al. | 112/265.2 X |

*Primary Examiner*—Werner H. Schroeder
*Assistant Examiner*—David K. Suto
*Attorney, Agent, or Firm*—Hill, Van Santen, Steadman & Simpson

[57] ABSTRACT

In a sewing of successive substantially rectangular fly pieces to a continuous slide fastener chain on a sewing machine, a corner of the leading end of the individual fly piece is automatically folded as the fly piece is advanced toward a sewing station defined by the sewing machine, then two plies of the folded corner are joined with a line of stitches when the fly piece is sewn to the slide fastener chain by the same stitches. A longitudinal edge of the fly pieces is serged with a line of overedge stitches running across the folded corner.

17 Claims, 5 Drawing Sheets

METHOD AND APPARATUS FOR SEWING FLY PIECES TO A SLIDE FASTENER CHAIN

BACKGROUND OF THE INVENTION

1. Field of the Invention:

The present invention relates generally to the production of closures for fly openings, and more particularly to a method and apparatus for sewing successive individual fly pieces one after another to a continuous slide fastener chain.

2. Description of the Prior Art

Various methods and apparatus for automatically or semi-automatically sewing individual fly pieces to a continuous slide fastener chain are known, such as exemplified in U.S. Pat. Nos. 4,362,116; 4,236,292; 4,152,996; and 4,576,104.

For attachment, the individual fly pieces are fed successively to a sewing station in underlying relation to the continuous slide fastener chain while they are kept in a closely spaced end-to-end relation. The fly pieces preferably have an elongate rectangular shape because owing to its rectangular shape, the leading end of each succeeding fly piece is able to abut in end-to-end relation to the trailing end of the preceding fly piece, thus assuring formation of a closely spaced end-to-end train of individual fly pieces while they are fed. The rectangular fly pieces are therefore widely used as shown, for example, in the above-mentioned U.S. Pat. Nos. 4,362,116 and 4,236,292.

However, such rectangular fly pieces encounter difficulties when they are attached to the trousers. As illustrated here in FIG. 8 of the accompanying drawings, when a rectangular fly piece 10 with a slide fastener 11 attached thereto is sewn to the front 12 of a pair of trousers by means of two lines of ornamental stitches, so-called "J-stitches" 13, a substantially triangular flap 14 is produced on the outside of the J-stitches 13. The triangular flap 14 is unsightly in appearance, makes the trousers appear unsightly and provides a sense of discomfort for the wearer, thereby limiting the use of the rectangular fly pieces. The formation of the triangular flap 14 can be avoided by sewing the rectangular fly piece 10 with the J-stitches 13 to the trousers front 12 while an outer corner of the rectangular fly piece 10 is being folded manually by an operator. Such sewing operation is tedious and time-consuming, requires a great deal of skill and considerably lowers the sewing efficiency. Furthermore, the J-stitches 13 are likely to run irregularly, resulting in a low product value.

Fly pieces used in the sewing operation shown in the aforesaid U.S. Pat. No. 4,152,996 have a curvature at the leading end as they are previously trimmed at one edge so as to conform a path of movement of the J-stitches. Such fly pieces can be neatly stitched to the trousers fronts with utmost ease. However, the fly pieces having such curved leading ends are likely to be displaced irregularly as they are conveyed toward a sewing station for attachment to a continuous slide fastener chain, with the result that the fly pieces joined by the slide fastener chain are disposed out of alignment with the slide fastener chain.

The prior art, as exemplified in the above-mentioned U.S. Pat. No. 4,576,104 and 4,362,116 contains a fly feed unit consisting of a series of opposed driven roller and idle support roller pairs or an endless belt conveyor which is disposed upstream of a sewing station for forcibly supplying fly pieces successively into the sewing station in underlying relation to a continuous slide fastener chain. Then, the fly pieces and the fastener chain are moved through the sewing station by means of a feed dog and a presser foot cooperating therewith as the stitching advances.

The conventional feed unit operates satisfactorily when the fly pieces are formed of a relatively thick and sturdy cloth such as denim. An accurate and reliable fly-piece feeding cannot be achieved however when the conventional feed unit is used with fly pieces of a relatively thin and flexible cloth because such relatively thin and flexible fly pieces are likely to overlap or become wavy as they are forced by the feed unit into the sewing station.

SUMMARY OF THE INVENTION

With the foregoing difficulties in view, an object of the present invention is to provide a method and apparatus for automatically sewing successive substantially rectangular fly pieces one after another to a continuous slide fastener chain, with a corner of the leading end of each fly piece folded over on the fly piece and stitched to an unfolded portion of the fly piece.

Another object of the present invention is to provide a method and apparatus for sewing fly pieces neatly onto a continuous slide fastener chain at a high rate of production, without causing an objectionable overlapping or waving of the fly pieces during conveyance to a sewing station even when the fly pieces are formed of a relatively thin and flexible cloth.

The present invention is summarized in a method and apparatus for sewing successive substantially rectangular fly pieces to a continuous slide fastener chain on a sewing machine, wherein a corner of the leading end of the individual fly piece is automatically folded as the fly piece is fed toward a sewing station defined by the sewing machine, then two plies of the folded corner are joined with a line of stitches when the fly piece is sewn to the slide fastener chain by the same stitches.

According to a first aspect of the present invention, there is provided a method of sewing successive substantially rectangular fly pieces to a continuous slide fastener chain, comprising the steps of: guiding a continuous slide fastener chain to a sewing station defined by a sewing machine; feeding substantially rectangular fly pieces one after another to the sewing station in underlying relation to the slide fastener chain; operating the sewing machine, thereby sewing the fly pieces to the slide fastener chain with at least one line of stitches while at the same time advancing the fly pieces and the slide fastener through the sewing station; automatically folding a corner of the leading end of each fly piece as it is fed toward said sewing station; and joining two plies of the folded corner of the fly piece with said line of stitches when the fly piece is sewn to the slide fastener chain.

According to a second aspect of the present invention, there is provided an apparatus for sewing successive substantially rectangular fly pieces to a continuous slide fastener chain, comprising: a sewing machine defining a sewing station for advancing the fly pieces and the slide fastener chain through the sewing station and for sewing the fly pieces to the slide fastener chain with at least one line of stitches during advancing; means for feeding the continuous slide fastener chain and the successive substantially rectangular fly pieces in superposed relation toward the sewing station; and means disposed upstream of the sewing machine for folding a corner of the leading end of each fly piece into a course of said line of stitches as the fly piece is advanced toward the sewing station so that two plies of the folded corner are joined together with said line of stitches when the fly piece is sewn to the slide fastener chain.

Many other advantages and features of the present invention will become manifest to those versed in the art upon making reference to the detailed description and the accompanying sheets of drawings in which preferred structural embodiments incorporating the principles of the present invention are shown by way of the illustrative example.

DETAILED DESCRIPTION OF THE PREFERRED EMBODIMENTS

Figure 1:
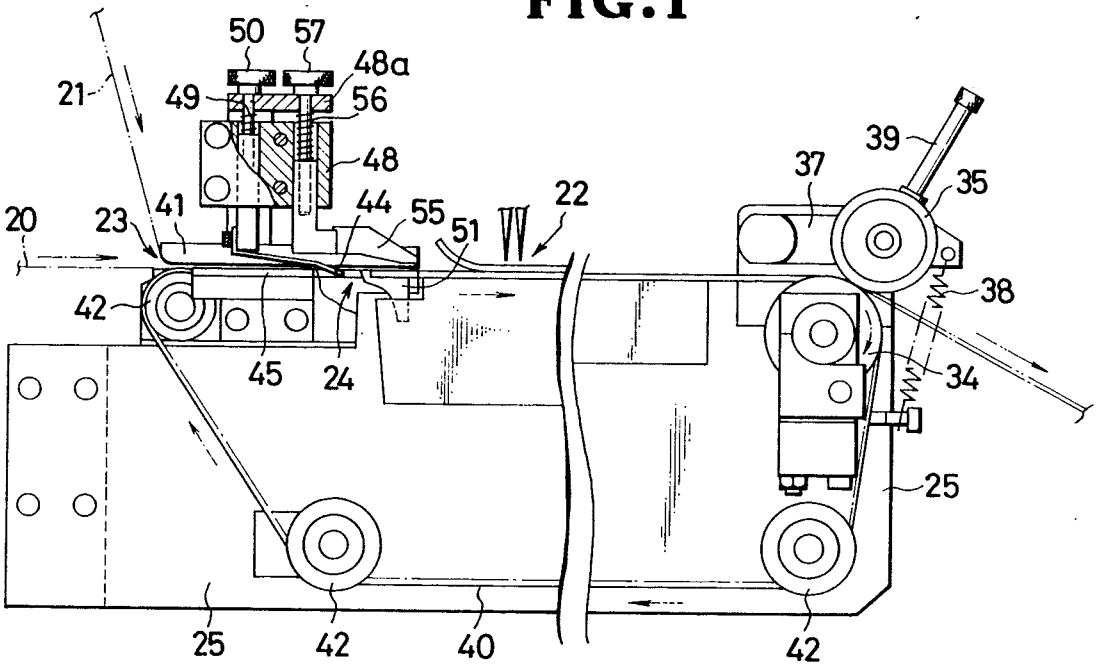
FIG. 1 is a diagrammatical front elevational view, with parts cut away for clarity, of an apparatus for sewing fly pieces to a continuous slide fastener chain according to the present invention.

As shown in FIG. 1, an apparatus for sewing successive fly pieces 20 to a continuous slide fastener chain 21 one after another in accordance with the present invention, generally comprises a sewing machine 22, a feed unit 23 for feeding the slide fastener chain 21 and the fly pieces 20 in superposed relation to the sewing( machine 22, and a fly corner folding unit 24 for automatically folding a corner of the leading end of the fly pieces 20 as the fly pieces are advanced toward the sewing machine 22, all the components 22–24 being mounted on a frame 25.

Figure 2:
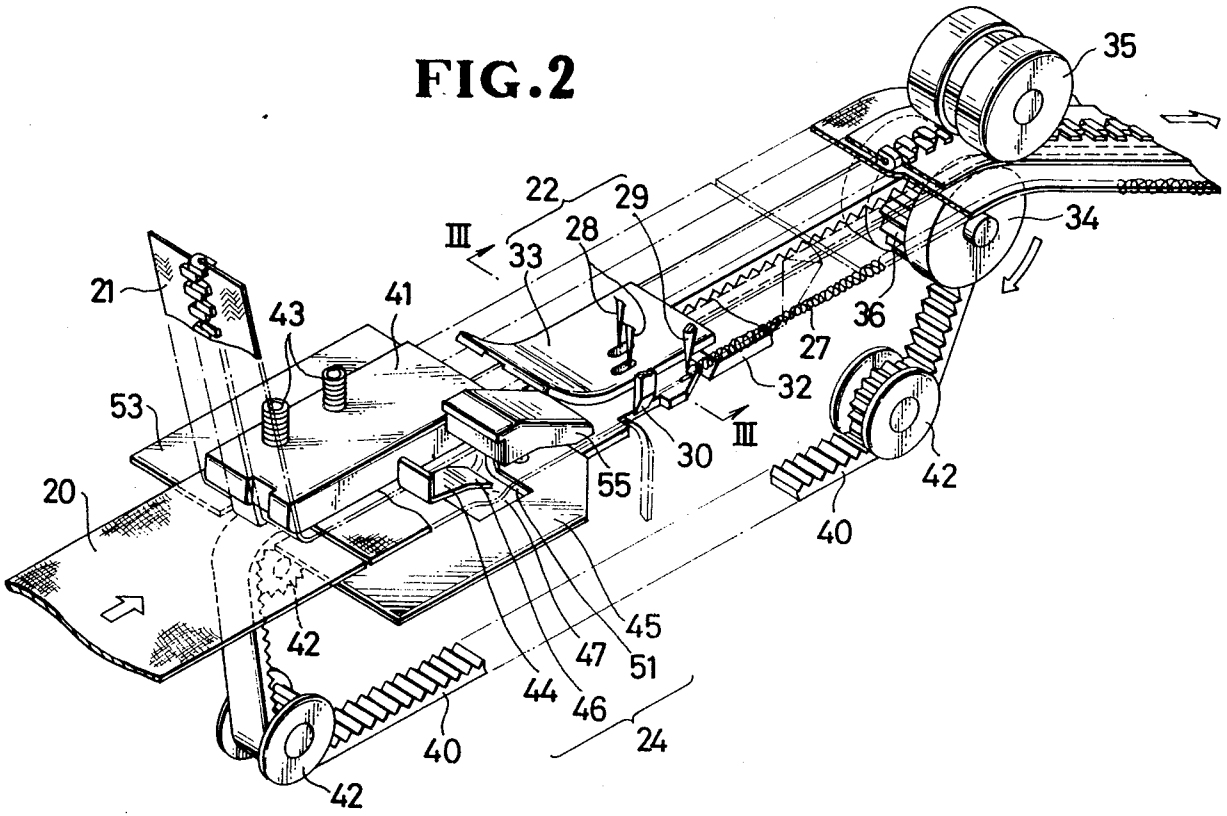
FIG. 2 is an enlarged perspective, partly cut away view of a main part of the sawing apparatus.
Figure 3:
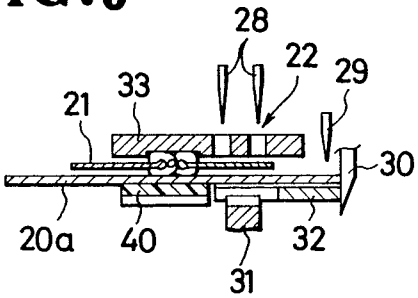
FIG. 3 is a cross-sectional view taken along line III—III of FIG. 2.
Figure 4:
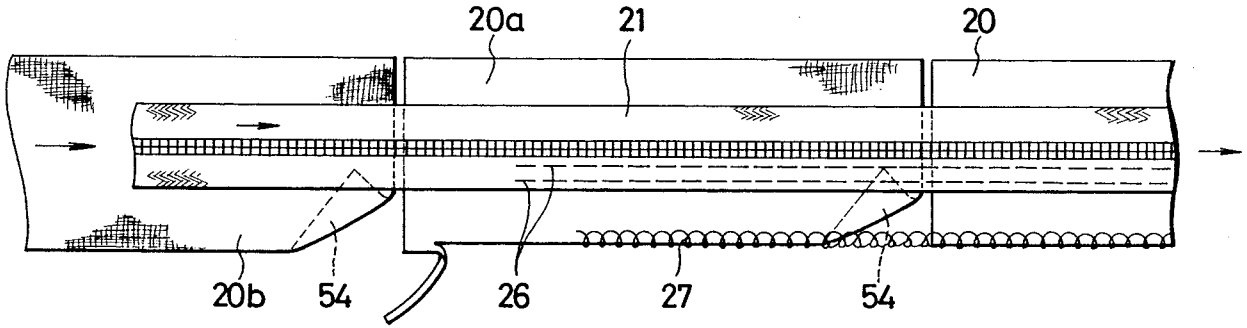
FIG. 4 is a plan view of three consecutive fly pieces as they are sewn to the slide fastener chain on the sewing apparatus shown in FIG. 2.

The sewing machine 22 is a conventional sewing machine which is capable of simultaneously forming a pair of straight lines of chain stitches 26 (FIG. 4) together with a line of overedge or serge stitches 27 (FIG. 4). To this end, the sewing machine 22 includes a dual chain stitch forming mechanism having a pair of needles 28, and a serge stitch forming mechanism having a needle 29, as shown in FIGS. 2 and 3. The sewing machine 22 further includes an edge trimming cutter 30 for trimming an edge of the fly piece being advanced into the serging station. A conventional feed dog 31 (FIG. 3) disposed below a horizontal needle plate 32 cooperates with a presser foot 33 to move the slide fastener chain 21 and fly pieces 20 through the sewing station in timed relation to the operation of the stitch forming mechanisms.

A drive roller 34 and a presser roller 35 are rotatably mounted on the frame 25 downstream of the sewing machine 22 and cooperate to withdraw the slide fastener chain 21 and the fly pieces 22 sewn thereto in synchronism with the operation of the sewing machine 22. The drive roller 34 is driven by a motor (not shown) and has an integral toothed timing pulley 36 (FIG. 2) for a purpose described below. As shown in FIG. 1, the presser roller 35 is supported on a pivot arm 37 mounted on the frame 25 and is normally urged against the drive roller 34 by a tension spring 38, the presser roller 35 being movable away from the drive roller 34 when a lever 39 on the pivot arm 37 is actuated to turn the pivot arm 37 counterclockwise in FIG. 1 against the force of the spring 38.

The feed unit 23 includes, as shown in FIGS. 1 and 2, an endless synchronous or timing belt 40 running from an upstream side to a downstream side of the sewing machine 22 across the sewing station for successively feeding the fly pieces 20 toward the sewing station, and a planar chain guide 41 disposed on the upstream side of the sewing machine 22 above the timing belt 40 for guiding the slide fastener chain 21 to the sewing station. The timing belt 40 is trained around the timing pulley 36 stated above and also around three timing pulleys 42 rotatably mounted on the frame 25 so that a longitudinal portion of the timing belt 40 running through the sewing station near the needles 28 lies in a plane slightly higher than the needle plate 32 of the sewing machine 22. The timing belt 40 is driven by the timing pulley 36 formed integrally with the drive roller 34. The chain guide 41 is vertically movably mounted on the frame 25 and normally urged downwardly against the timing belt 40 by means of a pair of compression coil springs 43 (FIG. 2) so that the slide fastener chain 21 and the fly pieces 20 are resiliently held between the chain guide 41 and the timing belt 40 as they are advanced toward the sewing station. The chain guide 41 is movable upwardly away from the timing belt 40 against the force of the springs 43 when the leading end of the slide fastener chain 21 is introduced into the sewing station.

As shown in FIG. 2, the fly corner folding unit 24 is disposed on one side of the timing belt 40 and includes a deflecting means 44 disposed upstream of the sewing machine 22 for deflecting a corner of the leading end of the fly pieces 20 downwardly as the fly pieces 20 are advanced toward the sewing station together with the slide fastener chain 21, a horizontal turn plate 45 disposed below the deflecting means 44 and having an opening 47 for receiving the downwardly deflected corner therein and then causing the thus-received corner to be folded over on the respective fly piece 20 as the advancing of the fly piece 20 proceeds.

The deflecting means 44 comprises a resilient deflecting finger disposed above the turn plate 45 and having a downwardly inclined lower end portion 46 projecting into the opening 47 in the turn plate 45. The deflecting finger 44 is slidably mounted on a guide block 48 (FIG. 1) secured to a vertical support bracket 48*a* mounted on the chain guide 41. A compression coil spring 49 acts between the vertical support bracket 48*a* and an upper end of the deflecting finger 44 to urge the deflecting finger 44 downwardly. The upper end of the deflecting finger 44 is connected with an adjustment screw 50 so that the extent to which the end portion 46 of the deflecting finger 44 projects into the opening 47 can be adjusted. When the apparatus is used with fly pieces of a different thickness, the vertical position of the lower end 46 of the deflecting finger 44 relative to the opening 47 is varied by turning the adjustment screw 50 in either direction. The guide block 48 is secured to the chain guide 41 and hence is vertically movable together with the chain guide 41.

Figure 5A:
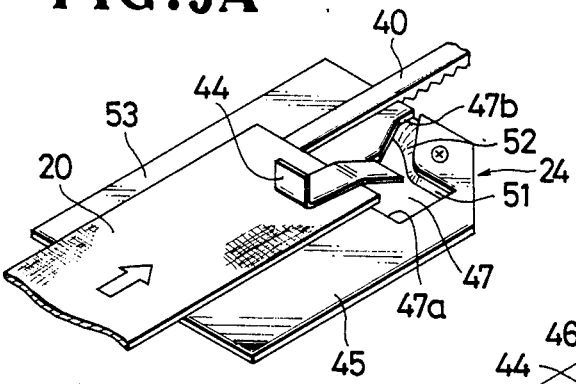
FIGS. 5A through 5D are schematic perspective views illustrative of the manner in which a corner of the leading end of one fly piece is folded.

The turn plate 45 is disposed on one side of the timing belt 40 and lies in the same plane as the needle plate 32, so that the timing belt 40 slightly projects upwardly from the turn plate 45. As shown in FIG. 5A, the opening 47 in the turn plate 45 includes a substantially rectangular portion **47*a* and a substantially beak-shaped oblique portion 47*b* contiguous to and extending from a front corner of the rectangular portion 47*a* obliquely toward the timing belt 40 for a purpose described later on. Preferably, the fly corner folding unit 24 further includes a fly turner 51 secured to the underside of the turn plate 45 adjacent to the beak-shaped oblique portion 47*b*. The fly turner 51 has a downwardly sloped guide surface 52 projecting into the beak-shaped oblique portion 47*b* for progressively folding the corner of the fly piece 20 over on the fly piece 20 as the corner of the fly piece 20 is moved through the opening 47. A horizontal guide plate 53 is disposed on an opposite side of the timing belt 40 and lies in the same plan as the turn plate 45 for guiding an edge portion of the fly pieces 20 and the fly pieces 20** are fed toward the sewing station.

The apparatus also includes means for resiliently holding the folded corner 54 (FIGS. 4 and 5D) of the fly piece 20 until the corner 54 arrives at the sewing station. The holding means comprises an L-shaped presser arm 55 disposed between deflecting finger 44 and the sewing machine 22 and vertically movable toward and away from the turn plate 45. The presser arm 55 is slidably mounted on a guide block 48 (FIG. 1) and normally urged downwardly by means of a compression coil spring 56 acting between the vertical guide bracket **48*a* and an upper end of the presser arm 55. The upper end of the presser arm 55 is connected with an adjustment screw 57 so that the spacing between a lower end of the presser arm 55 and the turn table 45** can be adjusted.

In operation of the apparatus of the foregoing construction, as shown in FIG. 1, a continuous slide fastener chain 21 unwound from a non-illustrated reel is guided between the chain guide 41 and the timing belt 40 while at the same time successive fly pieces 20 are supplied from a non-illustrated fly supply means onto the timing belt 40 in such a manner that the slide fastener chain 21 and the fly pieces 20 are superposed one on above the other between the chain guide 41 and the timing belt 40. The slide fastener chain 21 and the fly pieces 20 are fed to the sewing station in the sewing machine 22 by the timing belt 40 which is being driven to run in synchronism with the operation of the sewing machine 22. The sewing machine 22 forms a line of overedge stitches 27 (FIG. 4) on a longitudinal edge of the fly pieces 20 trimmed by the edge trimming cutter 30 and simultaneously forms a pair of straight lines of chain stitches 26 (FIG. 4) securing a tape of the slide fastener chain 21 to the fly pieces 20, as shown in FIG. 2.

Figure 5B:
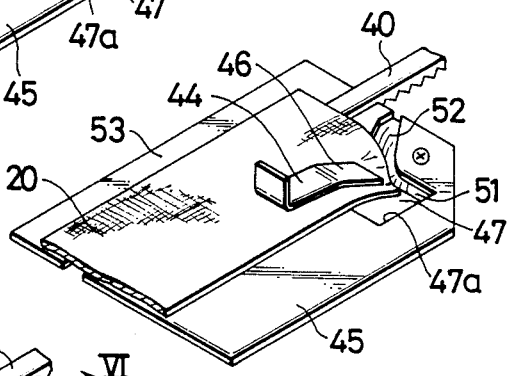
Figure 5C:
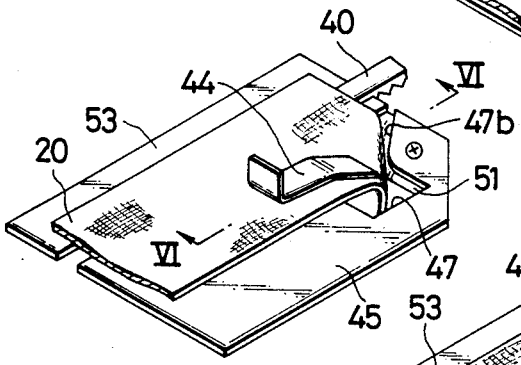
Figure 5D:
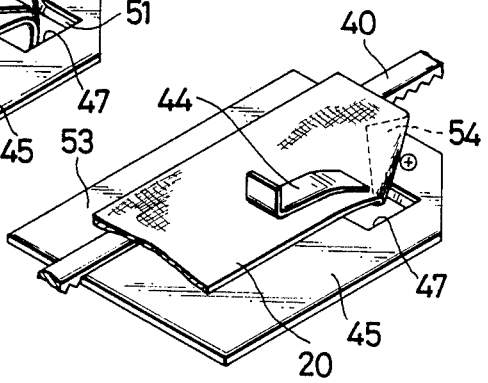
Figure 6:
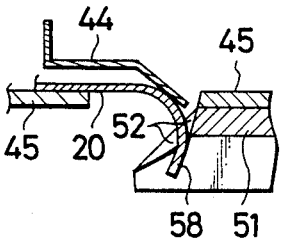
FIG. 6 is a cross-sectional view taken along line VI—VI of FIG. 5C.

In the course to the sewing station, the individual fly piece 20 approaches the opening 47 in the turn plate 45, as shown in FIG. 5A. As the fly pieces 20 further advances, a corner of the leading end of the fly piece 20 is caused to impinge upon the lower end portion 46 of the deflecting finger 44 whereupon the corner is deflected downwardly into the rectangular portion **47*a* of the opening 47 in the turn plate 45, as shown in FIG. 5B. A further advancing movement of the fly piece 20 causes the downwardly deflected corner to engage the beak-shaped oblique portion 47*b* of the opening 47 and then bend or curl downwardly and rearwrdly, as shown in FIG. 5C. The radius curvature of this bent corner 58 (FIG. 6) is progressively reduced as the bent corner 58 moves along the sloped guide surface 52 on the fly turner 51 which is disposed on the underside of the turn plate 45 adjacent to the beak-shaped oblique opening portion 47*b*. A continuing movement of the fly piece 20 forces the corner portion to move through the opening 47 and come up again on the turn table 45, whereupon the corner portion is completely folded as a substantially triangular flap 54 over on the fly piece 20, as shown in FIG. 5D. During its movement through the fly corner folding unit 24, the fly piece 20 is resiliently held between the timing belt 40 and the chain guide 41 with the slide fastener chain 21 disposed between the chain guide 41 and the fly piece 20. As a result, the fly piece 20 can be fed stably without overlapping with an adjacent fly piece or becoming wavy even when the fly piece 20** is formed of a relatively thin and highly flexible fabric material.

The fly piece 20 having the triangular flap 54 folded over on the fly piece 20 is further advanced toward the sewing station during which time the spring-biased presser arm 55 urges the triangular flap 54 against the turn plate 45 and also against the needle plate 32, so that the triangular flap 54 is kept in folded condition until its arrival at the sewing station. The presser arm 55 is not necessary when the fly pieces 20 are formed of a relatively thin and flexible material because the triangular flap 54 of each such thin and flexible fly piece 20 can be maintained in a folded condition as the fly piece 20 is moved under tension between the chain guide 41 and the sewing station. Preferably, the presser arm 55 is used in combination with fly pieces fomed of a relatively thick and sturdy material whick tends to unbent or spring back into its original shape. Thereafter, the triangular flap 54 is joined with an unfolded portion of the fly piece 20 with at least one of the two lines of chain stitches 26 and also with the overedge stitches 27 when the fly piece 20 is sewn to the slide fastener chain 21 by the two lines of chain stitches 26, as shown in FIG. 4. As shown in FIGS. 2 and 4, the fly corner folding unit 24 and the sewing station of the sewing machine 22 are spaced such that while a preceding fly piece **20*a* is being sewn to the slide fastener chain 21 by the sewing machine 22, a corner of the leading end of a succeeding fly piece 20*b* is automatically folded as a substantially triangular flap 54 over on the succeeding fly piece 20*b* by means of the folding unit 24. Since the timing belt 40 extends through the sewing station near the needle 28, the slide fastener chain 20 and the fly pieces 20 are held stably between the presser foot 33 and the endless belt 40 with the result that an objectionable overlapping or waving of the fly pieces 20 does not occur notwithstanding of the presence of the folded corner portions on the respective fly pieces 20. Then, the fly pieces 20 attached to the slide fastener chain 21 are withdrawn from the apparatus through the drive and presser rollers 34, 34. Thereafter, the slide fastener chain 21 with the fly pieces 20 attached thereto is wound on a reel, now shown, for storage or is subjected to a succeeding processing operation. With two plies of the folded corner stitched together, the fly piece 20 can be neatly attached by ornamental J-stitches to the front of a pair of trousers with utmost ease. Further, due to non-presence of a triangular flap disposed on the outside of the J-stitches, the fly piece 20** is sightly in appearance, makes the trousers appear sightly, does not provide a sense of discomfort for the wearer, and has a width variety of applications.

Figure 7:
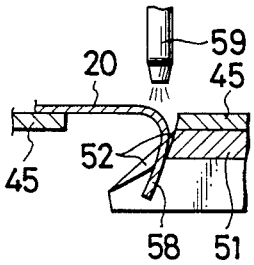
FIG. 7 is a view similar to FIG. 6, but showing a fly folding unit according to another embodiment of the present invention.
Figure 8:
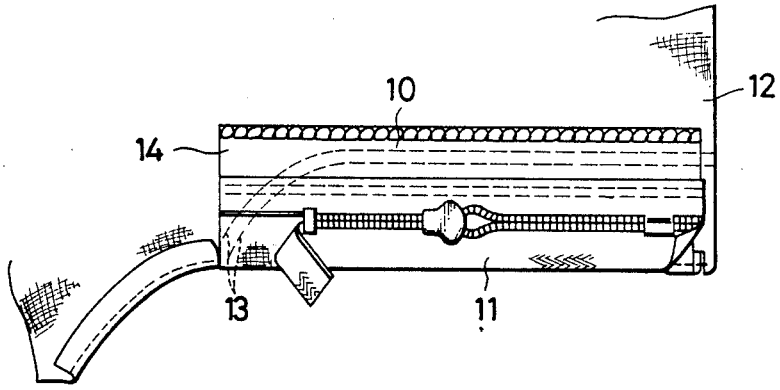
FIG. 8 (PRIOR ART)
FIG. 8 is a fragmentary plan view of a trouser fly unit as it is attached to the front of a pair of trousers, the view illustrative of a problem associated with a fly piece of the fly unit sewn to a slide fastener stringer according to a conventional practice.

Obviously, various modifications and variations of the present invention are possible in the light of the above teaching. For instance, the deflection finger 44 may be replaced with an air nozzle 59 directed in registry with the opening 47 and capable of deflecting a corner of the leading end of a fly piece 20 downwardly by means of a stream of air ejected from the nozzle 59, as shown in FIG. 7. It is therefore to be understood that within the scope of the appended claims the invention may be practiced otherwise than as specifically described.

What is claimed is:

1. A method of sewing successive substantially rectangular fly pieces to a continuous slide fastener chain, comprising the steps of:

(a) guiding the continuous slide fastener chain to a sewing station defined by a sewing machine;

(b) feeding substantially rectangular fly pieces one after another to the sewing station in underlying relation to the slide fastener chain;

(c) operating the sewing machine, thereby sewing the fly pieces to the slide fastener chain with at least one line of stitches while at the same time advancing the fly pieces and the slide fastener through the sewing station;

(d) automatically folding a corner of a leading end of each fly piece as it is fed toward said sewing station; and (e) joining two plies of the corner of the fly piece which is folded with said line of stitches when the fly piece is sewn to the slide fastener chain.

2. A method according to claim 1, said feeding including advancing the fly pieces and the slide fastener chain while resiliently holding them with the fly pieces underlying the slide fastener chain.

3. A method according to claim 1, said folding being achieved on a succeeding fly piece while a preceding fly piece is being sewn to the slide fastener chain.

4. A method according to claim 1, said joining further including serging a longitudinal edge of the fly pieces with a line of overedge stitches.

5. A method according to claim 1, further including a step of resiliently holding the corner which is folded until it arrives at the sewing station.

6. An apparatus for sewing successive substantially rectangular fly pieces to a continuous slide fastener chain, comprising:

(a) a sewing machine defining a sewing station for advancing the fly pieces and the slide fastener chain through said sewing station and for sewing the fly pieces to the slide fastener chain with at least one line of stitches during advancing;

(b) means for feeding the continuous slide fastener chain and the successive substantially rectangular fly pieces in superposed relation toward said sewing station; and (c) means disposed upstream of said sewing machine for folding a corner of a leading end of each fly piece into a course of said line of stitches as the fly piece is advanced toward said sewing station so that two plies of the folded corner are joined together with said line of stitches when the fly piece is sewn to the slide fastener chain.

7. An apparatus according to claim 6, said sewing machine including dual stitch forming means for forming a pair of lines of stitches attaching the fly pieces to the slide fastener chain, one of said pair of stitch lines running across the corners of the respective fly pieces which are folded, and serging means for serging a longitudinal edge of the fly pieces with a line of overedge stitches running across of the corners of the fly pieces which are folded.

8. An apparatus according to claim 6, said feeding means including an endless belt running from an upstream side to a downstream side of said sewing machine across said sewing station for successively feeding the fly pieces toward said sewing station, a chain guide disposed on the upstream side of said sewing machine above said endless belt for guiding the slide fastener chain to said sewing station, and resilient means for urging said chain guide toward said endless belt for resiliently holding the slide fastener chain and the fly pieces between the chain guide and the endless belt.

9. An apparatus according to claim 8, said endless belt comprising a timing belt.

10. An apparatus according to claim 9, further including a drive roller and a presser roller disposed downstream of said sewing machine and cooperative to withdraw the slide fastener chain and the fly pieces sewn thereto in synchronism with an operation of said sewing machine, said drive roller having a toothed timing pulley held in mesh with said timing belt.

11. An apparatus according to claim 6, said folding means including means in front of said sewing machine for deflecting said corner of each fly piece downwardly, and a turn plate disposed below said deflecting means and having an opening for receiving therein the corner of the fly piece which is downwardly deflected and causing the corner which is thus-received to be folded as the fly piece is advanced toward said sewing station.

12. An apparatus according to claim 11, said deflecting means including a deflecting finger disposed above said turn plate and having a downwardly inclined lower end portion projecting into said opening.

13. An apparatus according to claim 11, said deflecting means including an air nozzle disposed above said turn plate and directed in registry with said opening for ejecting pressurized air downwardly against the corner of the fly piece.

14. An apparatus according to claim 11, said opening in said turn plate including a substantially rectangular portion and a substantially beak-shaped oblique portion contiguous to and extending from a corner of said rectangular portion obliquely toward said sewing station.

15. An apparatus according to claim 11, said folding means further including a fly turner secured to the underside of said turn plate and having a sloped guide surface for bending the corner of the fly piece at a varying curvature progressively reducing as the corner of the fly piece is advanced through said opening.

16. An apparatus according to claim 6, further including means disposed between said folding means and said sewing machine for resiliently holding the folded corner of the fly piece.

17. An apparatus according to claim 16, said holding means including a plate for supporting thereon the fly pieces, a presser arm vertically movably disposed above said plate, and resilient means acting on said presser arm to urge said presser arm toward said plate.

* * * * *